US008443733B2

(12) United States Patent
Coots

(10) Patent No.: US 8,443,733 B2
(45) **Date of Patent: *May 21, 2013**

(54) SENSOR AND APPARATUS FOR POSITIONING RAILROAD TIE PLATES ALONG A RAILROAD TRACK AND METHOD

(75) Inventor: William R. Coots, Lebanon Junction, KY (US)

(73) Assignee: B&B Metals, Inc., Shepherdsville, KY (US)

( * ) Notice: Subject to any disclaimer, the term of this patent is extended or adjusted under 35 U.S.C. 154(b) by 218 days.

This patent is subject to a terminal disclaimer.

(21) Appl. No.: 12/940,651

(22) Filed: Nov. 5, 2010

(65) Prior Publication Data

US 2011/0113981 A1 May 19, 2011

Related U.S. Application Data

(63) Continuation-in-part of application No. 11/944,507, filed on Nov. 23, 2007, now Pat. No. 7,827,916.

(51) Int. Cl.
*E01B 29/32* (2006.01)

(52) U.S. Cl.
USPC ..... 104/16; 104/5

(58) Field of Classification Search
USPC ..... 104/2, 5, 16
See application file for complete search history.

(56) References Cited

U.S. PATENT DOCUMENTS 567,232 A 9/1896 Greenshield
594,731 A 11/1897 Dowe
636,702 A 11/1899 Wilton
703,755 A 7/1902 Bender
712,167 A 10/1902 Wood
832,332 A 10/1906 McConnell
832,333 A 10/1906 McConnell
832,334 A 10/1906 McConnell
1,593,423 A 7/1926 Bradley
2,762,313 A 9/1956 Sublett
3,282,506 A 11/1966 Holstein
3,943,858 A 3/1976 Dieringer et al.
4,168,771 A 9/1979 Krvec
4,241,663 A 12/1980 Lund et al.
4,631,639 A 12/1986 Biraud
4,686,909 A 8/1987 Burleson
4,691,639 A 9/1987 Holley
4,923,355 A 5/1990 Mancini
4,942,822 A 7/1990 Cotic
4,974,518 A 12/1990 Cotic et al.
5,067,412 A 11/1991 Theurer et al.
5,131,798 A 7/1992 Bell et al.
5,168,627 A 12/1992 Owen
5,331,899 A 7/1994 Holley (Continued)

*Primary Examiner* — S. Joseph Morano
*Assistant Examiner* — Zachary Kuhfuss
(74) *Attorney, Agent, or Firm* — Middleton Reutlinger; James E. Cole

(57) ABSTRACT

A method for positioning a replacement railroad tie plate along a railroad, comprising the steps of positioning a carrier vehicle on a railroad track, positioning a feed conveyor on the railroad track for movement with the carrier vehicle, moving a sensor assembly in a longitudinal direction of the feed conveyor and relative to a release point a first distance based upon a second distance between two adjacent ties, moving the carrier vehicle and the feed conveyor along the railroad track, detecting an in-service tie plate with the sensor assembly and, actuating a gate assembly upon the detection of the in-service tie plate.

21 Claims, 14 Drawing Sheets

U.S. PATENT DOCUMENTS

| | | | | |
|---|---|---|---|---|
| 5,542,355 | A | 8/1996 | Madison et al. | |
| 5,655,455 | A | 8/1997 | Smith | |
| 5,671,679 | A * | 9/1997 | Straub et al. | 104/2 |
| 6,134,775 | A | 10/2000 | Castillo | |
| 6,595,140 | B1 | 7/2003 | Madison et al. | |
| 6,647,891 | B2 | 11/2003 | Holmes et al. | |
| 6,807,909 | B1 | 10/2004 | Coots | |
| 7,082,879 | B2 | 8/2006 | Alt | |
| 7,827,916 | B2 | 11/2010 | Coots, Jr. | |
| 8,166,883 | B1 * | 5/2012 | Coots | 104/16 |
| 2002/0078853 | A1 * | 6/2002 | Holmes et al. | 104/2 |
| 2012/0192756 | A1 * | 8/2012 | Miller et al. | 104/2 |

* cited by examiner 140
142
144
60
62
66
16
16
14
14
18
18
18

SENSOR AND APPARATUS FOR POSITIONING RAILROAD TIE PLATES ALONG A RAILROAD TRACK AND METHOD

CROSS REFERENCES TO RELATED APPLICATIONS

This Continuation-in-Part application claims priority to, currently pending, U.S. patent application Ser. No. 11/944,507, having a filing date of Nov. 23, 2007.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to an apparatus for positioning railroad tie plates along a railroad track and more specifically to a sensor assembly used with the apparatus for positioning the railroad tie plates along the railroad track.

2. Description of the Related Art

Railroad tracks generally consist of two parallel steel rails, which are laid on railroad ties. Railroad ties are normally laid on a bed of coarse stone known as ballast, which combines resilience, some amount of flexibility, and good drainage characteristics. Railroad ties spread the load from the rails over the ground and also serve to hold the rails a fixed distance apart. The railroad ties are generally spaced apart a distance of about twenty-two inches on center although the distance may vary. On an upper surface of the railroad tie, is a tie plate or base plate. The tie plate connects the rail and the tie. Fasteners, such as spikes, screws or the like are often driven through a hole in the tie plate to hold the rail. Alternatively the rails may be clipped to the tie plates.

The steel rails can carry heavier loads than any other material. The rails generally have a foot, a web extending upwardly from the foot and a head. Additionally, the rails are spaced apart a preselected distance corresponding to wheel spacing of trains. The preselected distance between rails is known in the art as the gauge distance.

Over time, deterioration and repeated loading stress requires that the railroad ties be replaced during maintenance. Machines which deliver and position railroad tie plates along a railroad track bed are known in the art. One such device taught in U.S. Pat. No. 6,807,909 comprises an apparatus having a tire that engages tie plates at an end of a feed conveyor. The tire is operated by a timing transmission arrangement in order to deposit a tie plate when the apparatus rolls a preselected distance. The apparatus delivers a tie plate at each railroad tie within the rail gauge or alternatively on a rail bed side, depending on the desire of the maintenance crew.

However, one problem with the use of timing arrangements to deposit railroad tie plates is that over longer distances and periods of time, the likelihood of mis-positioning railroad tie plates increases. This is due to mechanical tolerances which are magnified over periods of time and therefore require adjustment when such timing is off. Specifically, it would be desirable to affirmatively detect the location of an existing tie plate and cause the depositing of a replacement tie plate at that location along the railroad track.

SUMMARY OF THE INVENTION

An apparatus for positioning railroad tie plates along a railroad track comprises a carrier vehicle having a carrier conveyor, a roller conveyor formed of frame members and a plurality of idler rollers, the roller conveyor having an upper input end and a lower output end for gravity feeding the plurality of tie plates, the roller conveyor adapted to receive a plurality of tie plates at the input end and feed the tie plates toward the output end, the roller conveyor connected to the carrier vehicle and in feeding communication with the carrier conveyor adjacent an input end of the roller conveyor, the roller conveyor further comprising a rolling support adjacent the output end for movable support of the roller conveyor along the railroad track, an actuator positioned at the output end of roller conveyor, the actuator successively engaging each of the plurality of tie plates during feeding, a sensor adapted to detect an in-service railroad tie plate wherein the sensor signals a controller and the controller actuates the actuator to eject the plurality of tie plates from the roller conveyor in a preselected spaced apart manner. The actuator is a hydraulic cylinder and piston. The actuator is mounted for side ejection from the roller conveyor. The apparatus further comprises a stop at the lower output end of the roller conveyor. The apparatus further comprises an ejection opening between the frame members and the stop. The actuator is positioned above the output end of the conveyor for downward movement of a piston to engage one of the plurality of tie plates. The sensor may be magnetic or an optical sensor. The actuator comprises a tire which engages each of the tie plates. The roller conveyor is substantially aligned with the vehicle for depositing the tie plates on a bed side position. The roller conveyor is non-aligned with the vehicle. The apparatus further comprises a manual actuation control button.

A mechanism for positioning tie plates along a railroad track in a spaced pattern, comprises a carrier vehicle, a gravity feed roller conveyor connected to the carrier vehicle, the gravity feed roller conveyor comprising a plurality of idler rollers extending from an input end to an output end, the input end being elevated relative to the output end for gravity feeding the tie plates, an actuator positioned at the output end of the gravity feed roller conveyor, the actuator engaging each of the tie plates consecutively, a sensor in electrical communication with a controller, the controller in electrical communication with the actuator, wherein the sensor is adapted to detect an in-service tie plate and signal the controller and further wherein the controller signals the actuator allowing depositing of one of the tie plates. The apparatus further comprises a stop located at an output end of the gravity feed roller conveyor. The tie plates engage the stop and are ejected by the actuator. The tie plates eject from an opening between the stop and a conveyor frame member. The tie plates are ejected in a direction substantially perpendicular to the conveyor frame. The apparatus further comprises a bracket at the output end. The actuator is connected to the bracket and engages the tie plates. The actuator deposits the tie plates in a direction substantially parallel to the conveyor frame. The apparatus further comprising a discharge assembly driven by transmission and discharging the tie plates.

An apparatus for depositing tie plates along a railroad track in a preselected spaced pattern comprises a feed conveyor having a conveyor frame, an input end, an output end and a rolling support, a plurality of rollers disposed within the conveyor frame for supporting the tie plates moving from the input end to the output end, a gate assembly located at the output end of the feed conveyor frame, a sensor in electronic communication with the gate assembly, wherein the sensor detects a tie plate and signals the gate assembly to actuate and deposit a tie plate.

A method for positioning a replacement railroad tie plate along a railroad, comprising the steps of positioning a carrier vehicle on a railroad track, positioning a feed conveyor on the railroad track for movement with the carrier vehicle, moving a sensor assembly in a longitudinal direction of the feed conveyor and relative to a release point a first distance based upon a second distance between two adjacent ties, moving the carrier vehicle and the feed conveyor along the railroad track, detecting an in-service tie plate with the sensor assembly and, actuating a gate assembly upon the detection of the in-service tie plate. The method wherein the detecting is performed by a laser sensor. The method wherein the detecting is performed by an optical sensor. The method wherein the detecting is performed by a magnetic sensor. The method wherein the detecting is performed mechanically by engaging at least one of the in-service tie plates. The method further comprises dispensing a replacement tie plate on a railroad tie. The method further comprises dispensing a replacement tie plate adjacent a railroad tie.

The method of positioning a replacement railroad tie plate along a railroad track, comprises the steps of positioning a carrier vehicle and a feed conveyor and railroad track, adjusting a sensor assembly in a longitudinal direction of the feed conveyor either toward or away from an ejection opening, a distance of the adjustment being dependent upon a distance between two adjacent in-service tie plates, feeding replacement tie plates from the carrier vehicle to the feed conveyor, urging the feed conveyor along the railroad track with the carrier vehicle, detecting in-service tie plates with the sensor assembly, actuating a gate assembly to release a replacement tie plate upon the detecting. The method wherein the actuating is electric. The method wherein the actuating is pneumatic. The method wherein the actuating is hydraulic. The method wherein the actuating is mechanical.

A method for positioning a replacement railroad tie plate along a railroad track, comprises the steps of positioning a carrier vehicle and feed conveyor on a railroad track, adjusting a sensor assembly relative to a release point of the feed conveyor depending on a distance between adjacent railroad ties, urging the carrier vehicle and the feed conveyor along the railroad track feeding tie plates from the carrier vehicle to the feed conveyor, detecting an in-service tie plate along said railroad track, actuating a gate-assembly when the in-service tie plate is detected, depositing a replacement tie plate on one of the railroad tie or an adjacent railroad tie. The method further comprising adjusting the sensor assembly in a longitudinal direction. The method further comprising adjusting the sensor assembly in a direction other than longitudinal. The method wherein the depositing is in a longitudinal direction. The method wherein the depositing being in a direction substantially perpendicular to the longitudinal direction. The method further comprising the feed conveyor based on a size of the replacement tie plate. The method further comprising positioning a sensor assembly on a bracket, the sensor assembly being movable relative to said bracket. The method further comprising a sensor assembly on a bracket, said bracket being movable relative to said feed conveyor. The method wherein the actuating is one of electric, hydraulic, pneumatic and mechanical.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
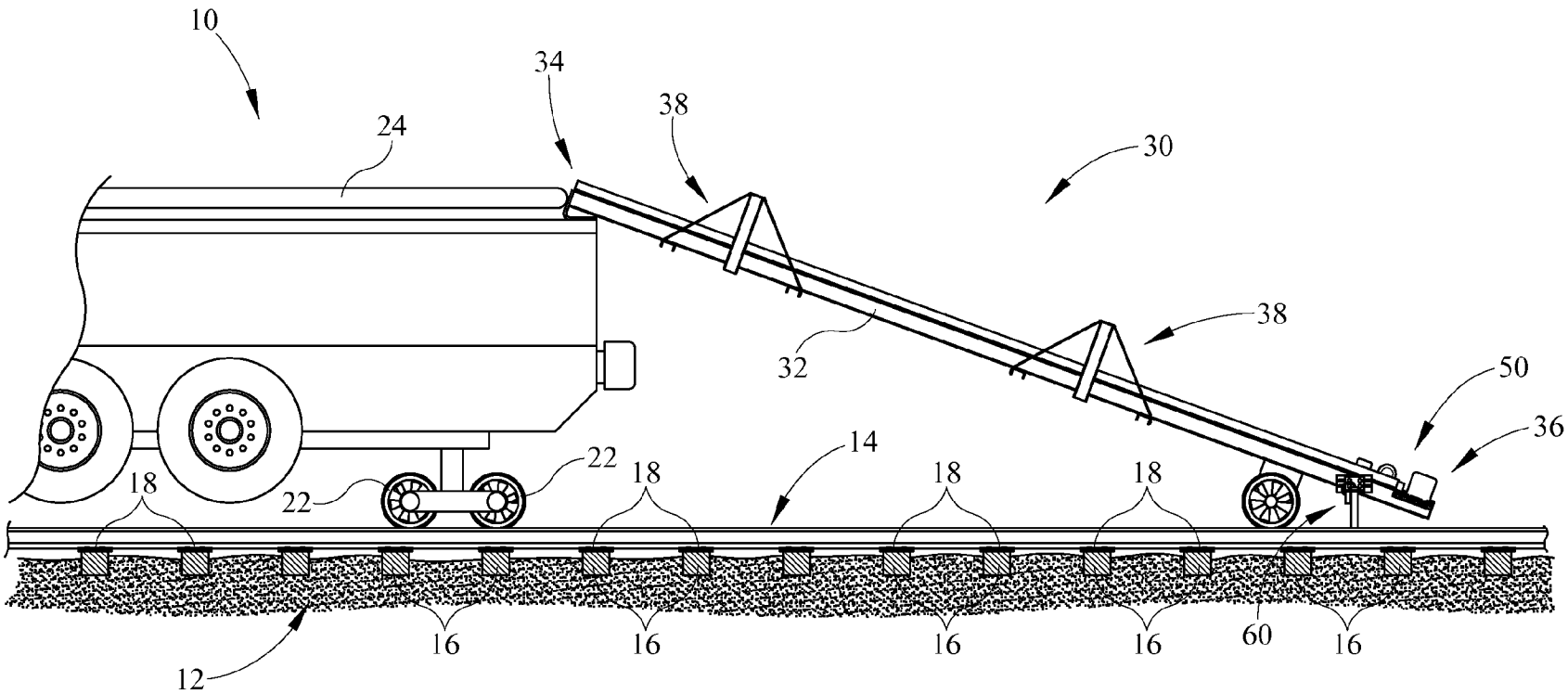
FIG. 1 is a side view of a feed conveyor assembly and a carrier.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-14 various aspects of a sensor and apparatus for positioning railroad tie plates along a railroad track and method.

Referring initially to FIG. 1, a side view of a feed conveyor assembly is depicted. A carrier vehicle 10 is partially shown located on a rail track 14. Beneath the rail track 14, a ballast 12 provides a substrate upon which a plurality of railroad ties 16 are disposed. The ballast 12 may be formed of rocks or other material which provides a stable base and allows for proper drainage. Further, the ballast 12 may have an upper elevation which raises the railroad to a height out of known flood plains. The railroad ties 16 are generally positioned about 22 inches apart, as is known in the art however, alternative spacing may be utilized. The railroad ties are generally rectangular having a square cross-section as shown in FIG. 1. Disposed on an upper surface of each railroad tie 16 are a plurality of tie plates 18. The tie plates 18 are anchored to the railroad tie 16 and provide a place for positioning of the railroad track 14. Although a single track is shown in the side view, as one skilled in the art will understand two tracks are laid in parallel fashion and spaced apart at a preselected gauge distance providing the railroad track system.

Figure 2:
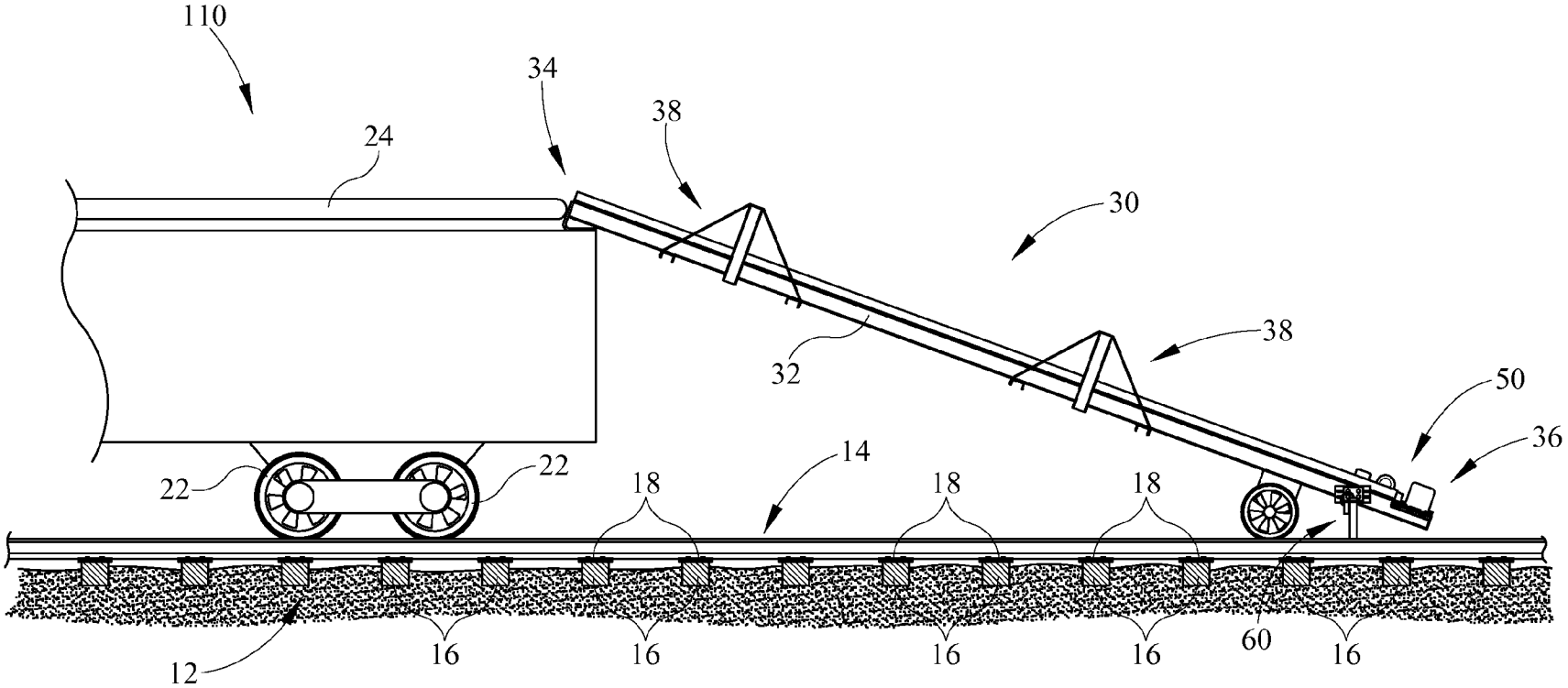
FIG. 2 is a side view of an alternative carrier and the feed conveyor of FIG. 1.

The carrier vehicle 10 may be a tractor as shown in FIG. 1 which is also usable on public roads or may be a converted railroad freight or may be a converted flatbed or boxcar or other non-powered device as depicted in FIG. 2. The carrier vehicle 10 of FIG. 2 employs a prime mover, such as a gasoline or diesel engine to power the vehicle and further comprises a cab wherein an operator may drive the vehicle 10. The carrier vehicle 10 comprises a plurality of railway wheels 22 for supporting movement of the carrier vehicle 10 along the rail track 14. Along an upper portion of the carrier vehicle 10 is a carrier conveyor 24 which receives the tie plates 18 stored on the carrier vehicle 10 for positioning along the plurality of railroad ties 16. The tie plates 18 may be manually placed on the conveyor 24 or located thereon by a crane device. Workers may also be positioned at one or more work stations on the vehicle 10 to align the tie plates 18 on the conveyor 24 for improved feeding. The carrier conveyor 24 delivers tie plates 18 to a feed conveyor 30 connected to a rear of the carrier vehicle 10. The carrier conveyor 24 may be embodied by various constructions which are not shown in detail. For example, the conveyor 24 may be a belt type conveyor, or may include a plurality of idler rollers which feed the tie plates by the manual force applied by a worker on the carrier vehicle 10 or by a mover such as hydraulic cylinder-piston ram, pneumatic or electric powered ram to force the tie plates 18 along the conveyor 24. The prime mover also provides hydraulic and electrical power for the carrier vehicle 10 as well as providing a power supply for a feed conveyor, described further herein. The prime mover may provide power for driving carrier vehicle 10 or alternatively the carrier may utilize an independent prime mover for powering only the conveyors and other assemblies of the instant invention.

The feed conveyor 30 is in feeding communication with the carrier conveyor 24 so as to deposit tie plates 18 along the ties 16 in order to aid maintenance work on a given section of railway. The feed conveyor 30 comprises a conveyor frame 32 having a first input end 34 and a second discharge end 36. The conveyor frame 32 may be formed of various frame members or structures having, for example, channel shapes, I-beam, L-beam (angle iron) shapes or other structural shapes. The frame 32 generally extends from the vehicle 10 in alignment with the track 14. Extending between the parallel structures are a plurality of rollers 31 (FIG. 3) which define a support surface of the conveyor 30 and upon which tie plates 18 are positioned for feeding. The rollers 31 are depicted as cylindrical rollers, closely spaced and journaled to support rotation and loading of the tie plates, as will be understood by one skilled in the art. The feed conveyor 30 is generally positioned for operation on a slope, for example about 10-15 degrees, although alternate angles may be utilized. At least one support structure 38 is located along the length of the conveyor frame 32 providing additional rigidity to the frame 32 and also providing a location where a crane may engage the feed conveyor 30 for positioning the feed conveyor 30 behind the carrier vehicle 10. As shown in the figure, the first input end 34 is in feeding communication with the carrier conveyor 24 to receive tie plates 18 from the carrier vehicle 10. The tie plates 18 move along the feed conveyor 30 to a gate assembly 50 in order to deposit the tie plates 18 along the railroad ties 18 or therebetween at some preselected spacing as desired by the maintenance crew. Alternatively, as described further herein, the tie plates 18 may be deposited on either side of the bed 12.

Figure 3:
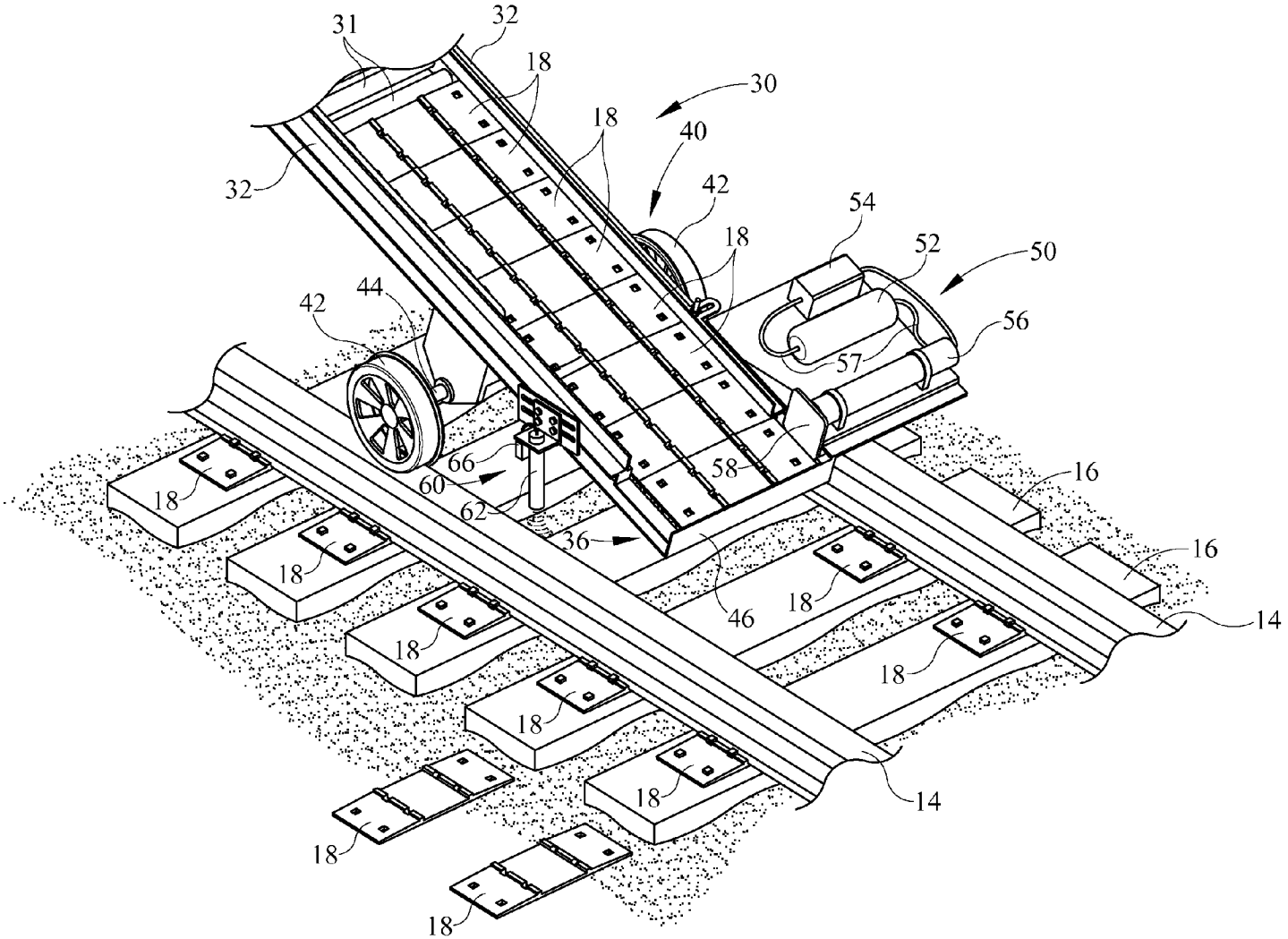
FIG. 3 is a perspective view of the discharge end of the feed conveyor assembly of FIG. 1.

Referring now to FIG. 3, a perspective view of the feed conveyor 30 adjacent the second end 36 is depicted. A rolling support structure 40 is disposed adjacent the second discharge end 36 of the feed conveyor 30. The rolling support structure 40 comprises first and second railway wheels 42 which engage the railway track 14 and support the frame 32. At least one axle 44 is associated with the railway wheels 42 allowing for rotational motion of the wheels 42 as the carrier vehicle 10 and feed conveyor 30 move along the track 14. The axle 44 and wheels 42 are dimensioned to correspond to the gauge distance between the rails 14. The at least one axle is supported by a strut depending from frame 32. The feed conveyor 30 is disposed at an angle relative to the track 14. The angle of the feed conveyor 30 provides that the tie plates 18 gravity feed along the rollers 31 of the feed conveyor 30 from the input end 34 (FIG. 1) to the discharge end 36 of the feed conveyor 30 along the plurality of idler rollers 31 extending between sides of the conveyor frame 32 and providing a bed upon which the tie plates 18 are movably supported. At a lower end of the feed conveyor 30 is a stop 46. As the tie plates 18 move downwardly along the feed conveyor 30 they are stopped at a lower end 36 of the feed conveyor 30 by the stop device 46. At this lowermost position the tie plates 18 are ready for discharge by the gate assembly 50. An opening is defined between the stop 46 and frame 32 which, according to the instant embodiment, allows for ejection of the tie plates 18 in a direction which is substantially perpendicular to the tracks 14 and longitudinally extending frame 32.

Also positioned at the second end 36 of the feed conveyor 30 is a gate assembly 50. The gate assembly 50 discharges the tie plates 18 from the feed conveyor 30 onto the railroad ties 16 beneath the second end 36 of the feed conveyor 30 as the feed conveyor 30 moves along the tracks 14. The gate assembly 50 works in combination with a sensor assembly 60. The sensor assembly 60 detects in-service tie plates 18 in position along railroad ties 16 as the feed conveyor 30 moves along the track 14. When the sensor assembly 60 detects an in-service tie plate 18, the gate assembly 50 is signaled and operates to eject or discharge a tie plate 18 from the feed conveyor 30 and onto the tie 16 or therebetween at some preselected spacing. The gate assembly 50 comprises a hydraulic fluid reservoir 52 in fluid communication with a motor-pump assembly 54. The motor-pump assembly 54 may include a separate motor and pump or a single integrated unit comprising both the motor and the pump. The hydraulic fluid reservoir 52 and motor-pump assembly 54 are also in fluid communication with an actuator, such as a cylinder-piston assembly 56. The piston may comprise a plate 58 at an end which engages the tie plates 18 located on the feed conveyor 30 at stop 46 in order to eject the tie plates 18 onto the railroad ties 16 or therebetween. The ejection is signaled by the sensor assembly 60. The sensor assembly 60 comprises a housing 62 wherein a sensor 64 is positioned. The sensor 64 is in electronic communication with a controller 66 which receives signals from the sensor 64 and directs the gate assembly 50 to actuate. The sensor assembly 60 may be located at various locations along the feed conveyor 30. As depicted the sensor assembly 60 is adjacent the output end of the feed conveyor 30 near the gate assembly 50, however, the sensor assembly 60 or at least the sensor 64 and housing 62 may be positioned forward of a release point so that when an in-service tie plate 18 is detected a replacement tie plate 18 may be deposited from the feed conveyor 30 onto or adjacent a tie 16. In other words, the distance between the sensor assembly 60 and the release point may be substantially equal to the distance between two adjacent ties 16.

Figure 4:
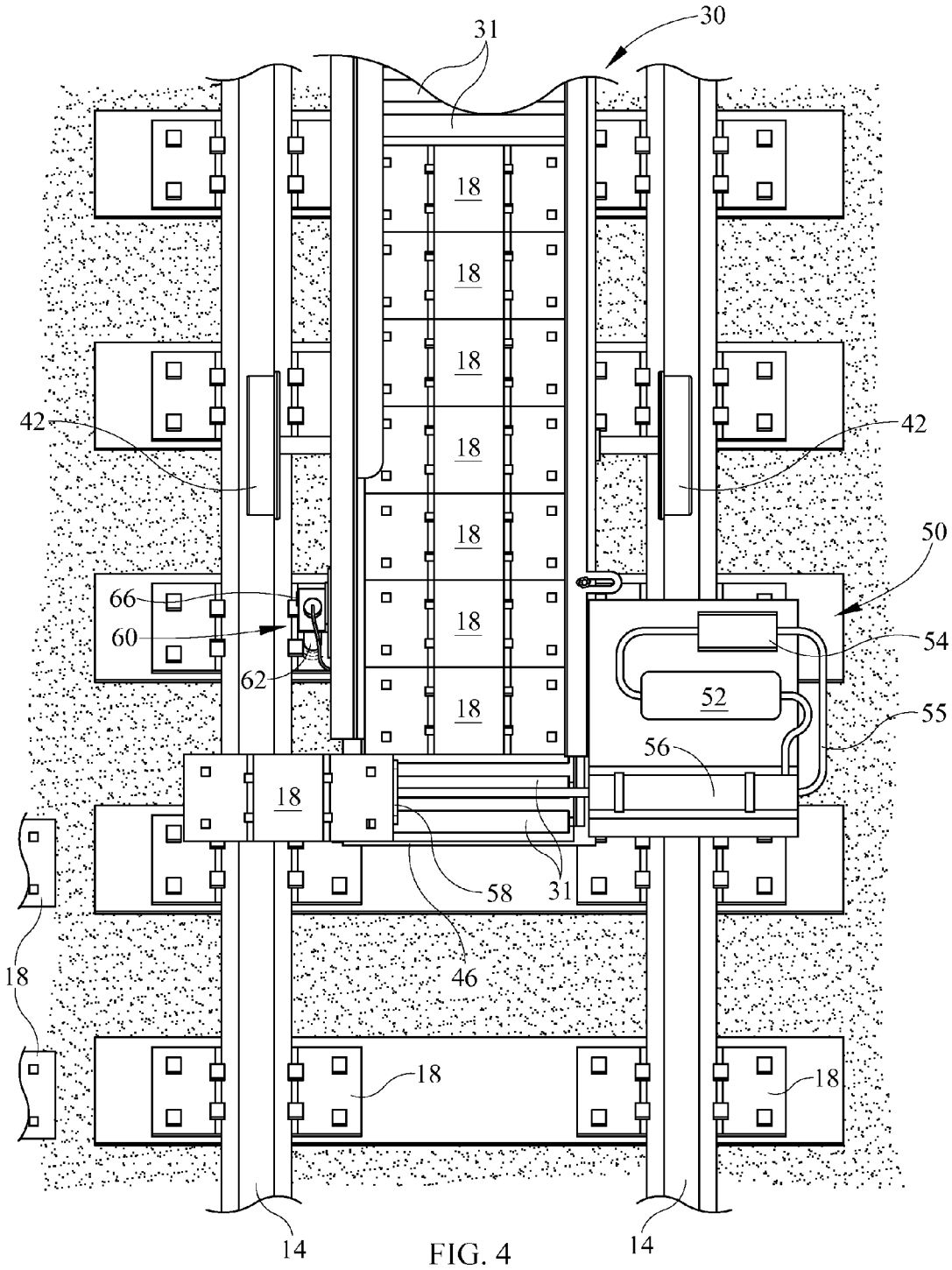
FIG. 4 is a top sequence view of the feed conveyor assembly with a gate assembly in a first position.
Figure 5:
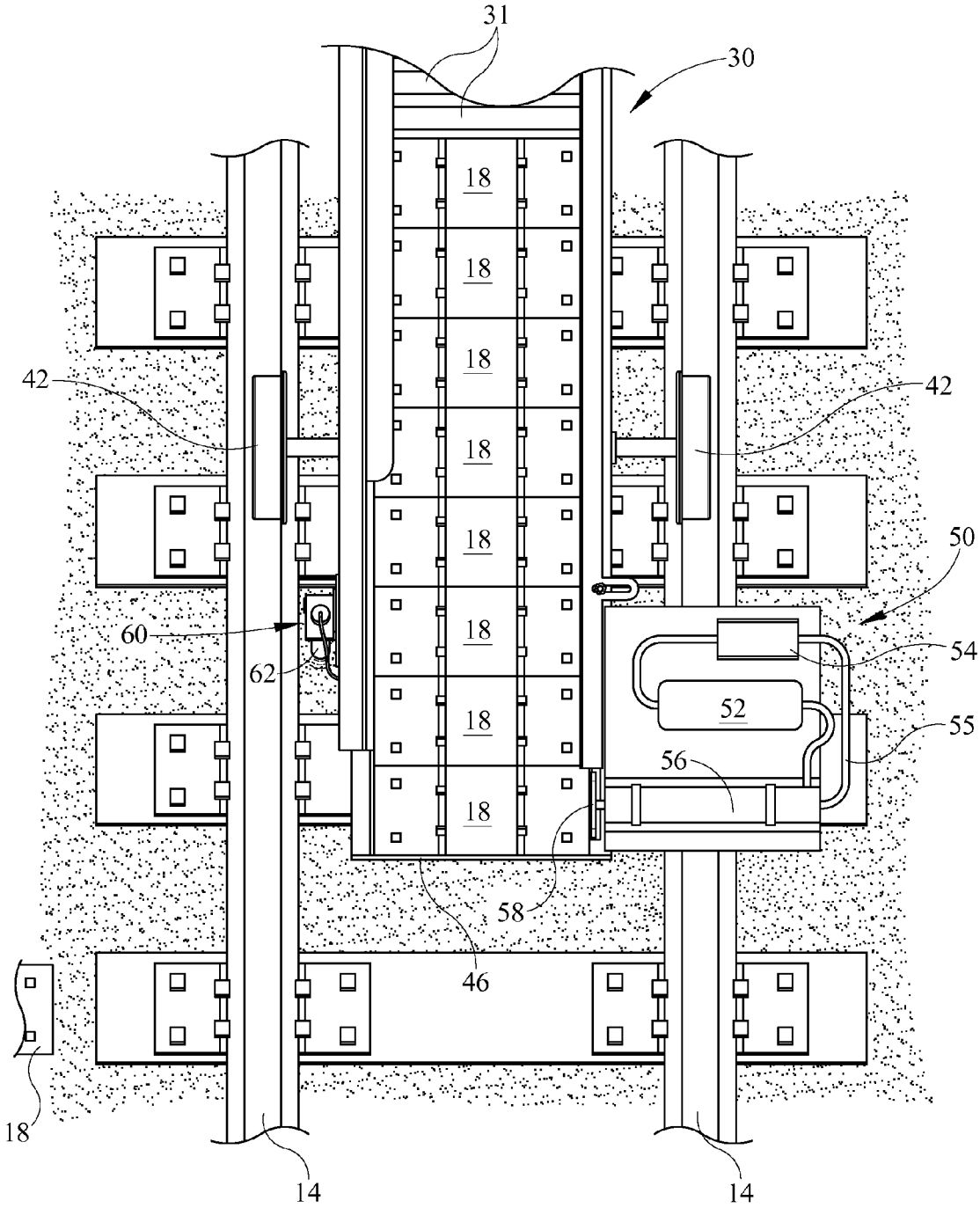
FIG. 5 is a top sequence view of the feed conveyor assembly with a gate assembly in a second position.

Referring now to FIGS. 4 and 5, top sequence views of the gate assembly 50 are depicted. Briefly referring to FIG. 3, the tie plates 18 are aligned along the feed conveyor 30 with the gate assembly 50 in the retracted position and ready to eject a lowermost tie plate 18 onto the railroad tie 16 below. In FIG. 4, the sensor assembly 60 has detected a tie plate 18 causing the controller 66 to signal the gate assembly 50 to actuate. Accordingly, the piston of the cylinder-piston assembly 56 is extended causing the lowermost tie plate 18 to be displaced from a side of the feed conveyor 30.

As the tie plate 18 is ejected by the cylinder-piston assembly 56, the next consecutive tie plate 18 moves downwardly by gravity toward the stop 46 along the rollers 31. FIG. 5 depicts the cylinder-piston assembly 56 in a retracted position so that the next subsequent tie plate 18 is moved down the feed conveyor 30 and disposed against the stop 46 ready for ejection by the cylinder-piston assembly 58. This sequence is repeated each time the sensor assembly 60 detects an in-service tie plate 18 along the tracks 14.

As shown in FIGS. 3-5, the frame 32 may include at least one frame member which is adjustable in a width-wise direction, perpendicular to the feed direction, in order to receive tie plates 18 of varying size. The tie plates come in different sizes so the frame 32 may be adjustable to compensate for any size tie plate needing to be positioned on the railroad track.

Figure 6:
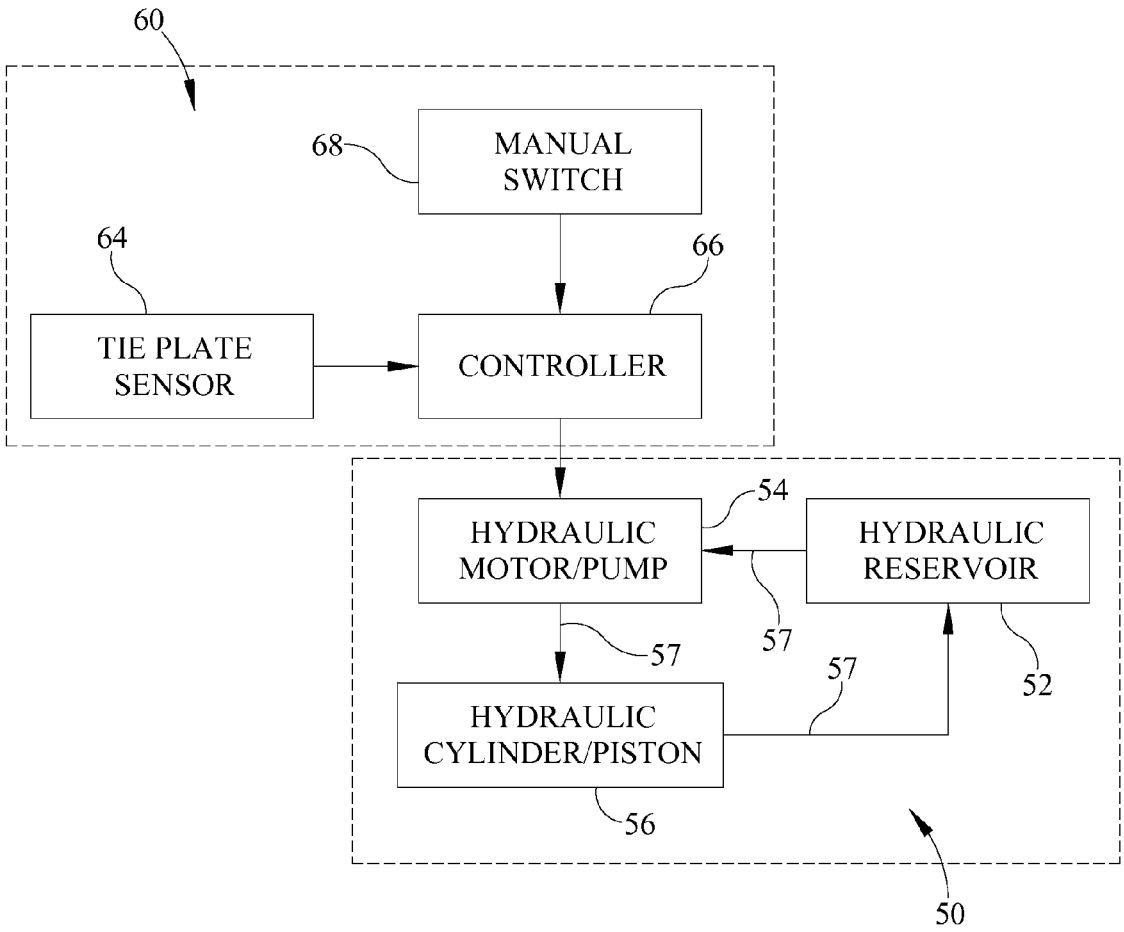
FIG. 6 is a schematic view of the gate assembly and a sensor assembly of the feed conveyor.

Referring now to FIG. 6, a schematic diagram indicates the interaction between the gate assembly 50 and the sensor assembly 60. The gate assembly 50 is depicted as a hydraulic system having the hydraulic reservoir 52 in fluid communication with a pump 54, which may also include a motor, as well as a hydraulic cylinder-piston assembly 56. The hydraulic components 52, 54, 56 are all in fluid communication by a plurality of fluid conduits 57 which may include rubber hoses, couplings, rigid piping or a combination thereof. Adjacent the gate assembly 50 is the sensor assembly 60. The sensor assembly includes a tie plate sensor 64 which is depicted by the housing 62 in FIG. 3. The tie plate sensor 64 is in electric communication with a controller 66. The controller 66 is in electric communication with the motor-pump 54 to control operation of the pump and therefore actuation of the cylinder-piston 56. The sensor assembly 60 also is depicted having a manual switch 68 which may be located in the cab (not shown) of the carrier vehicle 10. The manual switch 68 may be used to manually actuate the cylinder-piston assembly 56 and therefore manually eject the tie plates 18. Alternatively, the manual switch 68 may be located along the carrier conveyor 24 or in an alternative location of the carrier vehicle 10 where a worker may be stationed or along the feed conveyor 30.

The sensor assembly 60 may utilize various types of sensors 64 to detect the tie plates 18. For example, a magnetic sensor may be utilized to detect the metal tie plate 18. Alternatively, a laser sensor may be utilized to indicate positioning of an in-service tie plate 18 signaling ejection of a new tie plate by the gate assembly 50. In still a further alternative, the sensor 64 may include an optical sensor which detects change in light readings caused by the change in color between the tie plate 18 and the tie 16 or ballast 12.

Like the sensor assembly 60, alternative gate assemblies 50 may be utilized as well. The cylinder-piston assembly 56 may be replaced with an electric solenoid which is connected to the controller 66. In an electric solenoid arrangement, the hydraulic components such as the motor-pump assembly 54 and the reservoir 52 are not required for use. In still a further alternative, a pneumatic system may be utilized comprising a pneumatic cylinder-piston assembly, a compressed air tank and a compressor. In either event, the gate assembly 50 may receive hydraulic power or electrical power from the carrier vehicle 10 in order to operate the gate assembly 50 and/or the sensor assembly 60.

Figure 7:
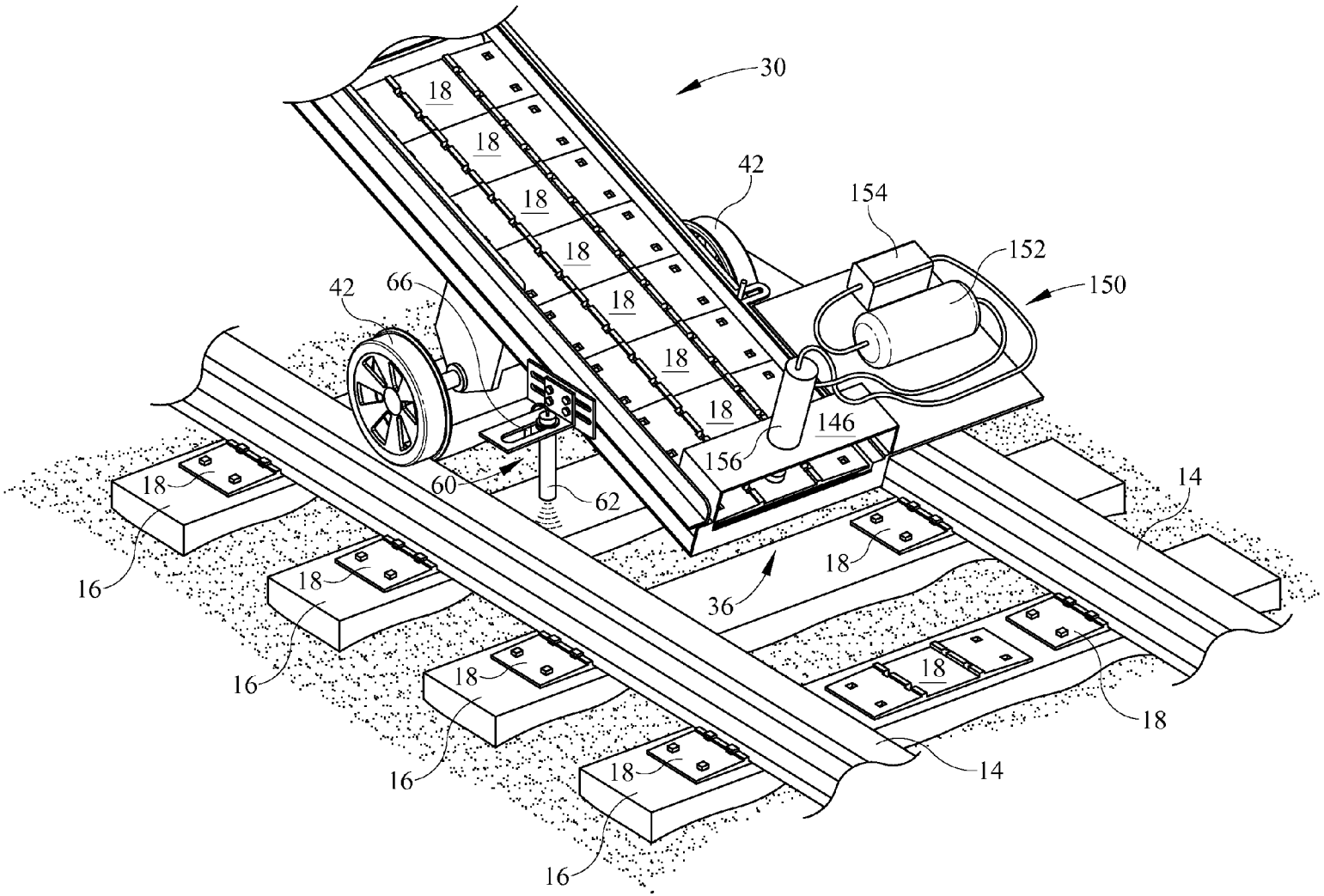
FIG. 7 is a perspective view of an alternative feed conveyor assembly.

Referring now to FIG. 7, a perspective view of the feed conveyor 30 is depicted with an alternative gate assembly mechanism 150. As opposed to the previously described embodiment which utilizes a side ejection, generally perpendicular to the feed movement of the tie plates 18 along the feed conveyor 30, the gate assembly 150 discharges the tie plates 18 disposed on the feed conveyor 30 in a direction aligned with the longitudinal axis of the feed conveyor 30 at the second end 36 of the feed conveyor 30. The gate assembly 150 comprises a motor-pump assembly 154 in fluid communication with a reservoir 152 and further in fluid communication with a cylinder-piston assembly 156. At the second end 36 of the feed conveyor 30, a bracket 146 extends across the top of the feed conveyor 30. The cylinder-piston assembly 156 is positioned on the bracket 146 so that the piston extends downwardly toward the feed area of the conveyor 30 so as to engage an upper surface of the tie plates 18. When the cylinder-piston assembly 156 is in a normal position, the piston is extended downwardly engaging the tie plates 18 inhibiting motion of the plates 18 along the feed conveyor 30 and further inhibiting ejection of the plates 18 onto the railroad ties 16. When the piston 156 is actuated, the piston 156 retracts and gravity allows feeding of the tie plates 18 across the rollers 31 and onto the ties 16 or therebetween, in any event at some preselected spacing.

Figure 8:
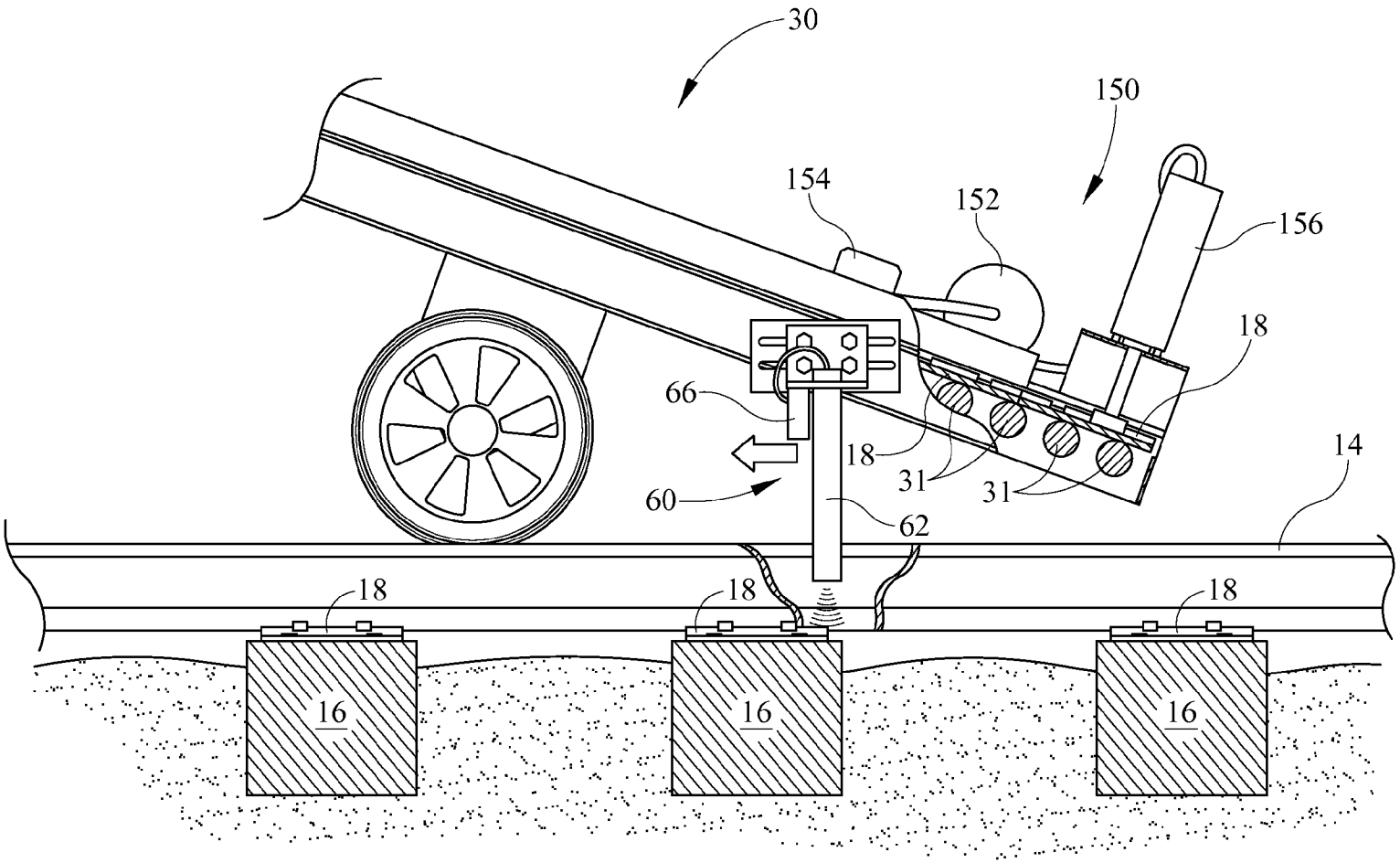
FIG. 8 is a side sequence view of the alternative feed conveyor in a first position.
Figure 9:
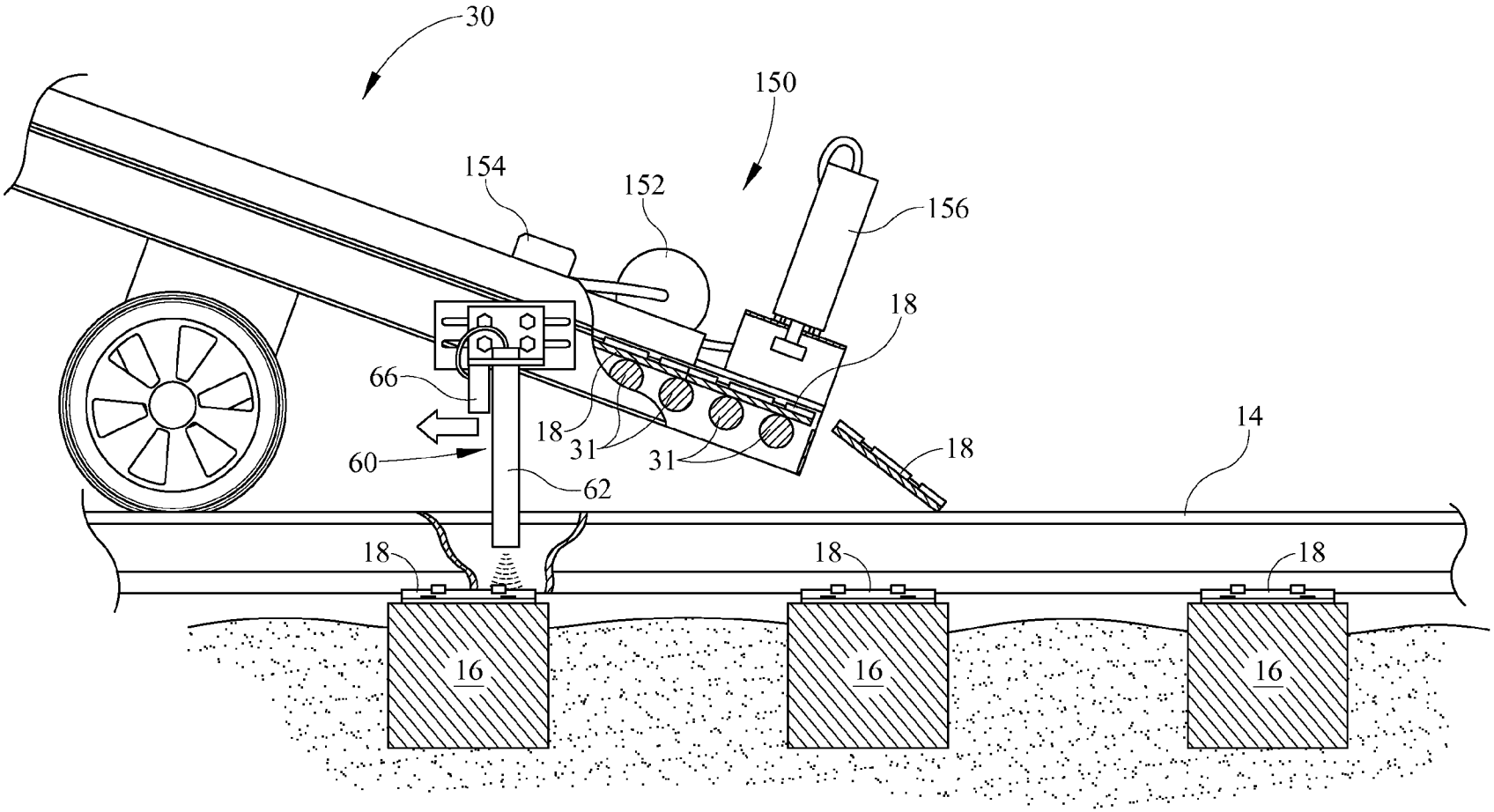
FIG. 9 is a side sequence view of the alternative feed conveyor assembly in a second position.

Operation of the embodiment depicted in FIG. 7 is shown in side sequence views of FIGS. 8 and 9. The cylinder-piston assembly 156 is generally positioned perpendicularly to the roller 31 surface of the feed conveyor 30. Thus, when the piston 156 extends downwardly, engaging the upper surface of the tie plates 18, the tie plates 18 are inhibited from rolling along the feed conveyor 30 until the piston 156 is retracted by actuation of the gate assembly 150. Due to the potentially large forces on the rollers 31 beneath the cylinder-piston assembly 156, larger rollers or higher strength bearings may be utilized in this area of the feed conveyor 30.

As shown in FIG. 9, the cylinder-piston assembly 156 is retracted due to the sensor 60 detecting an in-service tie plate 18. The rollers 31 in combination with the angle of the feed conveyor 30 allow gravity feed of a tie plate 18 from the feed conveyor 30 to a preselected position on the railroad ties 16 or at a position therebetween. Once the in-service tie plate 18 is no longer detected, the cylinder-piston 156 extends to stop the next consecutive tie plate 18.

Figure 10:
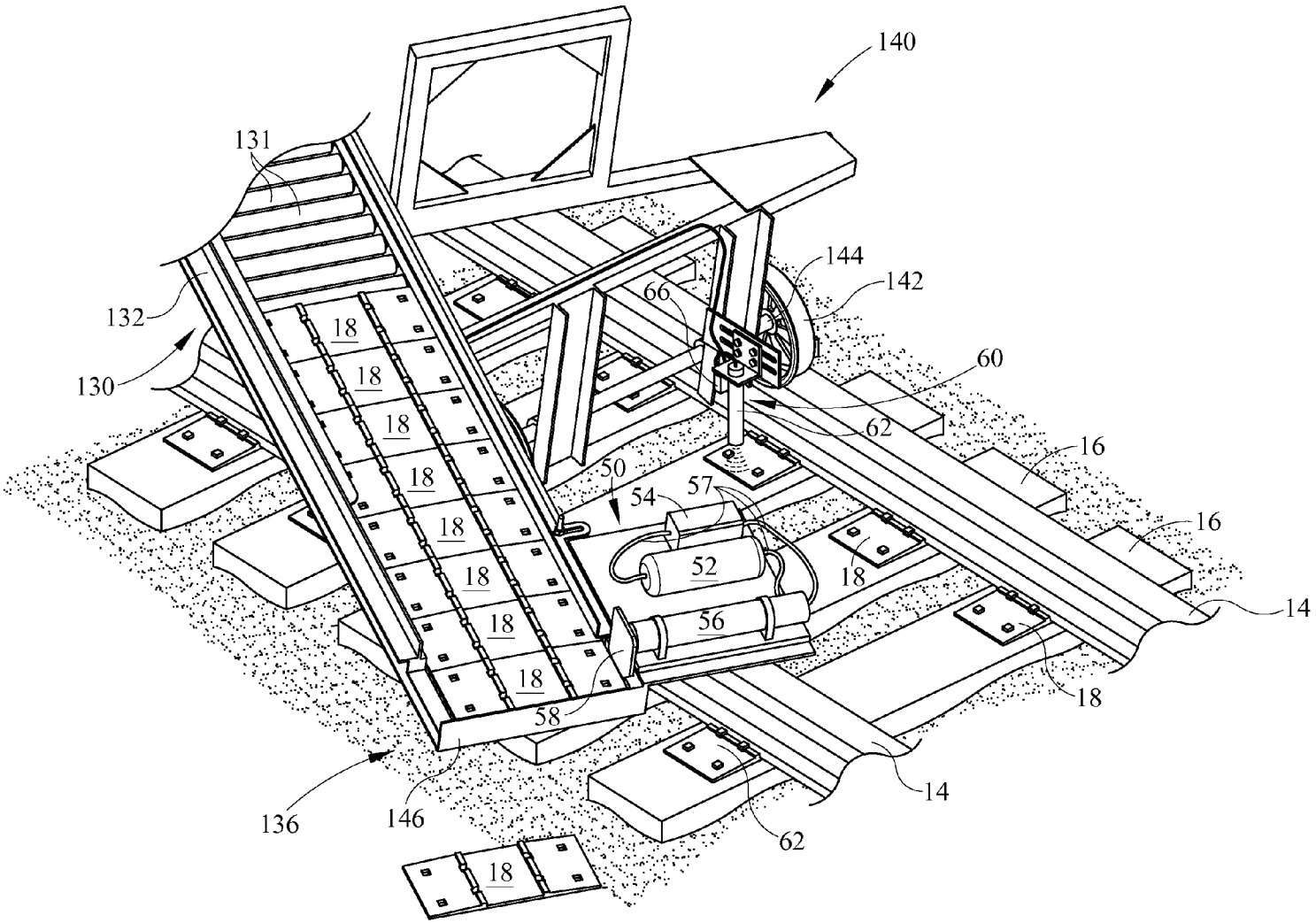
FIG. 10 is a perspective view of an alternative feed conveyor assembly which disposes tie plates along the bed side of the railroad tracks.

Referring now to FIG. 10, an alternative feed conveyor 130 is depicted. In some instances, railroad maintenance crews desire tie plates 18 to be located on a bedside rather than within the gauge between the tracks or rails 14. As a result, it is desirable to provide an assembly which allows for disposition of the tie plates from the feed conveyor to a location on the bed or ballast side of the rails 14. According to the embodiment shown in FIG. 10, the feed conveyor 130 extends from a support structure 140 at an angle so as to eject the tie plates at the bedside of the railroad tracks 14. One skilled in the art will understand that the instant embodiment depicts the conveyor extending to a first side of the ballast however, the feed conveyor 130 may be built so as to extend from the opposite side. The feed conveyor 130 comprises the parallel frame members 132 and a plurality of rollers 131 extending between the frame members 132. The tie plates 18 are located between the frame members 132 on the rollers 131 and are gravity fed downwardly toward the gate assembly 50 and the sensor assembly 60. These assemblies are, as previously described, utilized to detect an existing, in-service tie plate and eject a new tie plate 18 near that location for subsequent installation by a maintenance crew. The feed conveyor 130 is not aligned with the rails 14 as in the previous embodiments, thus allowing the tie plates 18 to be ejected at a bed side of the railroad tracks 14 and ties 16 rather than within the gauge. The assembly is depicted with gate assembly 50 however alternative assemblies, such as gate assembly 150 or gate assembly 250 described further herein may be utilized.

Figure 11:
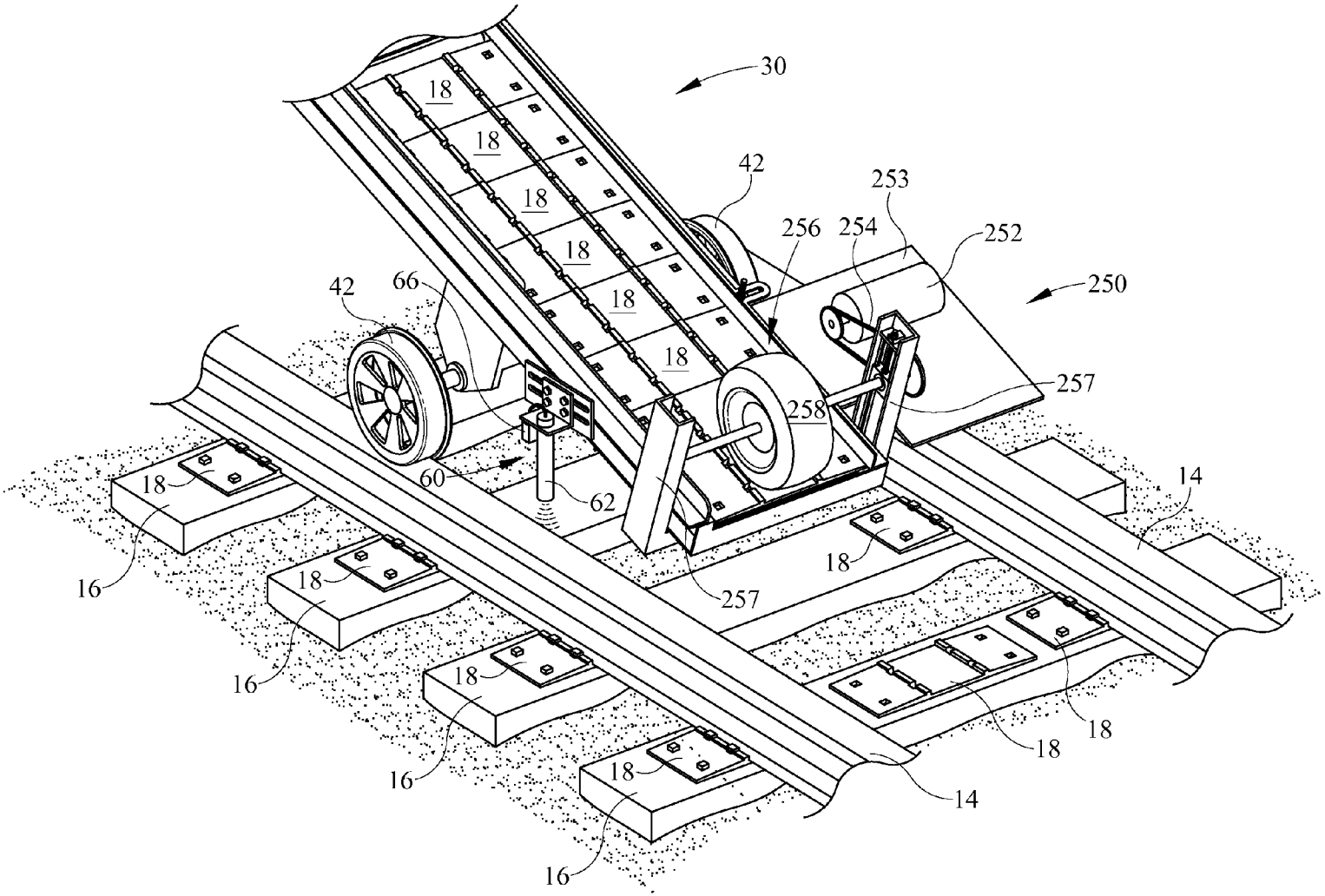
FIG. 11 is a perspective view of an alternative feed conveyor assembly.

Referring now to FIG. 11, a perspective view of the feed conveyor 30 is depicted. An alternative feed assembly 250 is positioned on a feed conveyor 30, which positions the tie plates 18 within the gauge, however, the feed assembly 250 may alternatively be utilized with the feed conveyor 130 which positions tie plates 18 along the outside of rails 14. At a lower end of the conveyor 30, the gate assembly 250 is positioned. The gate assembly 250 utilizes a rotating discharge assembly 256 to discharge the tie plates 18 on to the railroad ties below upon signaling by the sensor assembly 60. The gate assembly 250 also comprises a motor 252 disposed on a frame 253 adjacent the discharge assembly 256. The motor 252 may be electric or hydraulic powered. The motor 252 is operably connected to the tire/wheel assembly 256 by a transmission 254. The exemplary transmission 254 is embodied by a chain drive, however other transmissions may be utilized such as a gear transmission, belt drive, or other known transmission means. As previously described, the sensor assembly 60 is connected to the feed conveyor 30. The sensor assembly 60 is positioned to detect in-service tie plates 18 prior to the end of feed conveyor 30 being positioned over that corresponding tie 16.

The discharge or actuator assembly 256 comprises opposed journal bars 257 between which an axle is extending. A wheel 258 is located on the axle and suspended between the journal bars 257. The wheel 258 is driven by the transmission 254 and motor 252 to drive tie plates 18 from the conveyor 30 when the sensor 60 detects an in-service tie plate 18.

Figure 12:
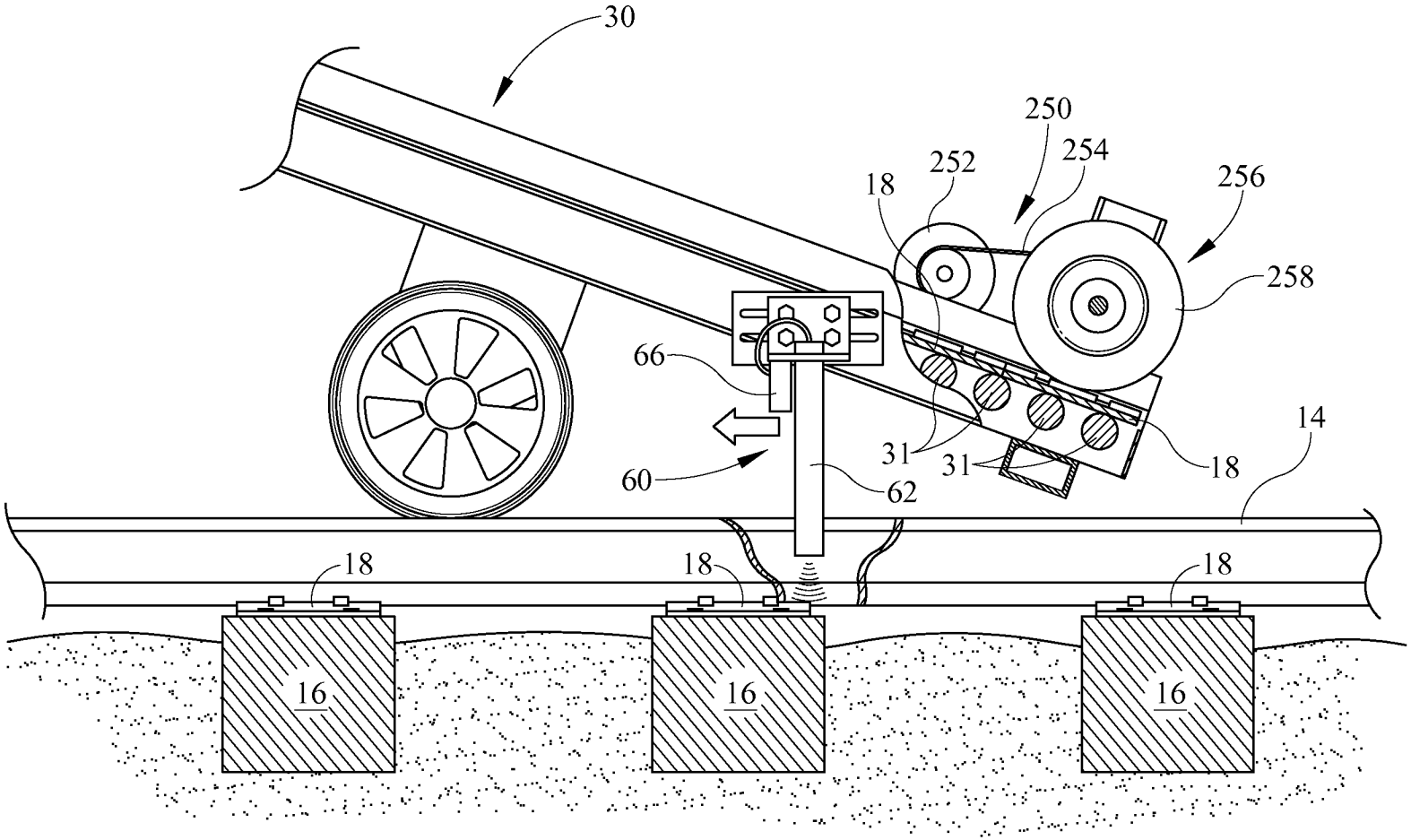
FIG. 12 is a first side sequence of the alternative feed conveyor assembly of FIG. 11.
Figure 13:
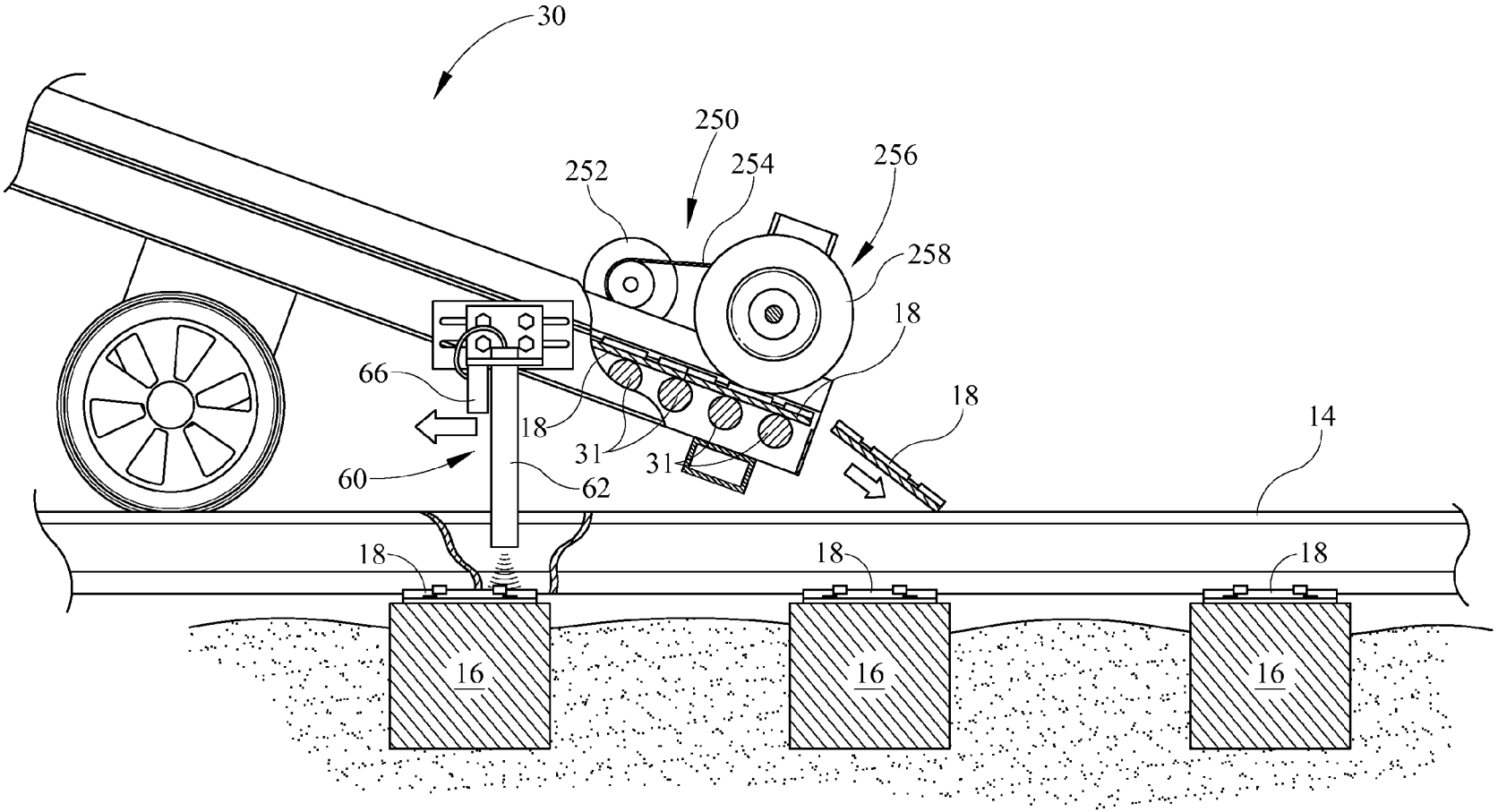
FIG. 13 is a second side sequence view of the alternative feed conveyor assembly of FIG. 11; and, FIG. 14 is a flow chart depicting at least one method used with the instant invention.

Referring now to FIGS. 12 and 13, side sequence views of the embodiment of FIG. 11 are depicted. The adjustable sensor assembly 60 is depicted for detecting an in-service tie plate 18 on the feed conveyor 30, which is depicted moving to the left in the figures. A tie plate 18 is disposed at the discharge end of the feed conveyor 30 beneath the wheel 258. Since the sensor assembly 60 is depicted detecting an in-service tie plate 18, a signal is sent from the sensor, represented by housing 62, to the controller 66. Next, the controller 66 signals the motor 252 to rotate, driving the transmission 254 and the actuator assembly 256, including the wheel 258.

As shown in FIG. 13, feed conveyor 30 has moved to the left of the position shown in FIG. 12. The controller 66 has signaled the motor 252 in order to discharge a tie plate 18, which has rotated causing the wheel 258 to rotate via the transmission 254. The tie plate 18, previously shown at the end of the feed conveyor 30 is depicted falling from the feed conveyor 30. The amount of rotation of the motor 252 may depend on various factors such as the speed of the carrier vehicle 10 pulling the feed conveyor 30, the diameter of the wheel 258, spacing of the ties 16 and the size of the tie plates 18. The tie plate 18 discharged from the feed conveyor 30 is disposed on the tie 16 where the sensor assembly 60 detected an in-service tie plate 18 in FIG. 12, as one skilled in the art will understand. Also, one skilled in the art will understand that although a tie plate 18 is disposed on a tie 16 which was detected, via an in-service tie plate 18, in FIG. 12, the instant discharge systems may also depict an in-service tie plate on one tie 16 and deposit a tie plate on an adjacent tie 16 since the spacing between ties 16 is known to be generally consistent along a stretch of railroad. Further, the system may be timed to discharge two tie plates on a tie or one tie plate on a tie and one tie plate between ties upon detection of an in-service tie plate 18.

Figure 14:
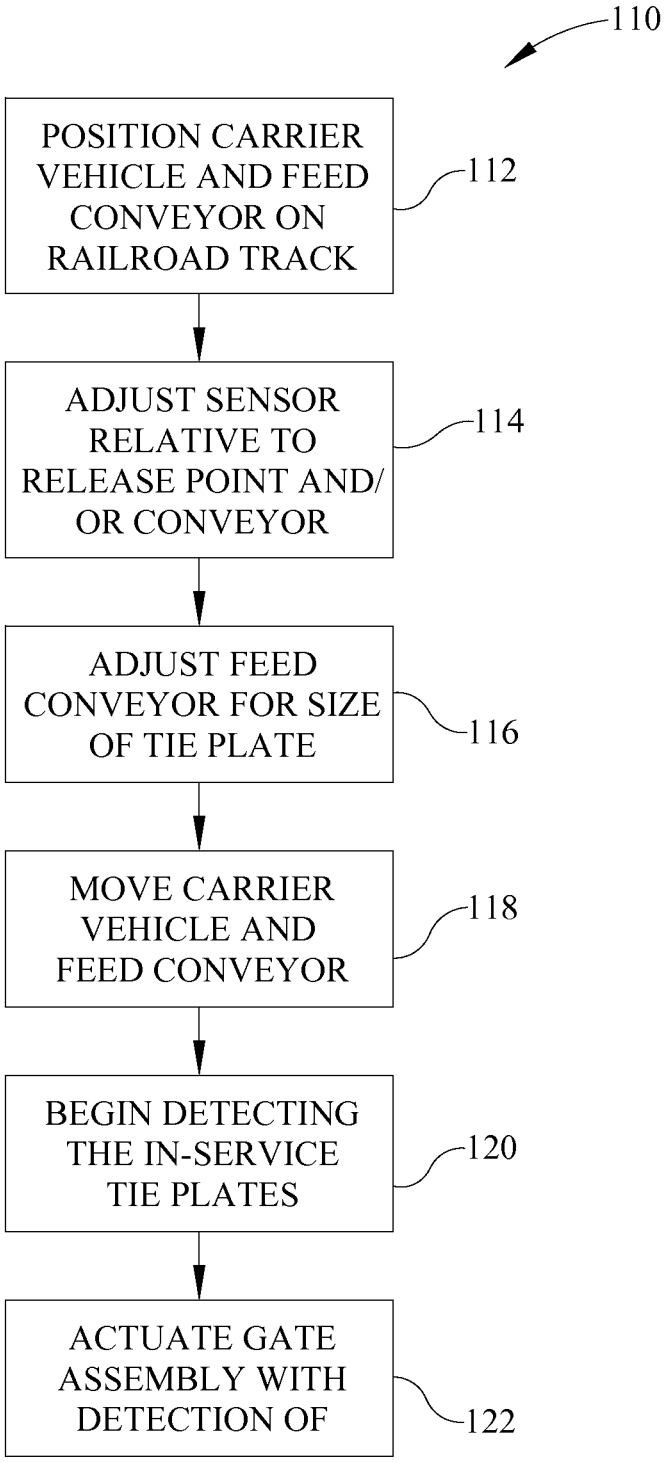

Referring now to FIG. 14, a flow chart depicts at least one method 110 taught herein where a feed conveyor utilizes a sensor to actuate and deposit tie plates on or around railroad ties for immediate or subsequent installation. In an initial step 112, a carrier vehicle and a feed conveyor are positioned on a railroad track. The vehicle and the feed conveyor are disposed on the track in an orientation so that the longitudinal axis of the vehicle and feed conveyor are parallel to the longitudinal axis of the railroad track.

Next, the sensor is adjusted at step 114. This adjustment may be the sensor alone or may be the entire sensor assembly. For example, an elongated sensor assembly may be formed to allow the sensor to move therein. Alternatively, the entire assembly, including sensor, may be formed to move. The sensor and/or sensor assembly (hereinafter, "sensor assembly") may need to be adjusted since different railroads are often provided with different distances between railroad ties. Accordingly, the sensor assembly may be moved or adjusted in the longitudinal direction of the feed conveyor some distance toward or away from the release point of the tie plates. This movement can compensate for distances between the in service tie plates being detected and the release point to allow for improved placement of the tie plates either on the railroad tie or adjacent the railroad tie depending on where the desired placement of the replacement tie plate will be. Additionally, the movement of the sensor assembly allows for easier calibration of the placement of the tie plates. For example, if the tie plates are going to be deposited on a railroad tie, it would be preferable to position the sensor either at the release point or alternatively, space the sensor assembly some multiple of the distance between that tie and an adjacent tie. The distance adjusted therefore may be dependent upon the distance between adjacent in-service tie plates. This allows for increased accuracy and allows time to compensate for the time required to actuate the gate assembly and deposit the tie plate or other variables such as distance between the sensor and the release point of the tie plates from the gate assembly. Other distances may be used as desired to compensate for lag in the gate assembly or to compensate, as needed, for speed of the carrier vehicle and feed conveyor. Alternatively, if tie plates are desired to be deposited in an offset arrangement relative to the railroad tie (i.e., partially on or not on the railroad tie), the positioning of the sensor assembly may be adjusted so that the tie plates are deposited in such a fashion. Additionally, the movement of the sensor assembly may further include movement in a direction substantially perpendicular to the railroad tie plate movement along the feed conveyor. This is shown in FIG. 7 by way of arrow and may be necessary to provide improved recognition or detection of the tie plates on the railroad ties and may be accomplished through the use of a bracket providing for such adjustment. Although this perpendicular adjustment is only shown in a single embodiment, it should be understood that this perpendicular adjustability may be utilized with any of the embodiments depicted and alone or in combination with the longitudinal adjustment shown in the various embodiments. It should also be clear from the description that adjustment of the sensor assembly may not be necessary if the feed conveyor was used previously on or along a railroad track known to operate with the last used settings of the sensor assembly.

In addition to the adjustment of the sensor, the feed conveyor, as previously described, may be adjusted at step 116 to compensate for the variation in size of replacement tie plates to be fed. Some tie plates are specified larger in various dimensions than others depending on various factors. The feed conveyor may need adjustment to at least accommodate a change in width, the distance perpendicular to the feed direction of the tie plates along the feed conveyor.

Next, at step 118, the carrier vehicle and the feed conveyor are moved along the track. At this time, the replacement tie plates either have started or do start feeding along the feed conveyor. This may additionally include feeding the replacement tie plates from the carrier vehicle to the feed conveyor. At step 120 the sensor assembly, including sensor therein, begin detecting the in-service tie plates as the vehicle moves along the railroad track. During this step, the detection may occur by way of magnetic, electronic, optical, laser or mechanical detection, such as by mechanical contact with the in-service tie plates or railroad ties as previously described. As the detection occurs, the gate assembly is actuated at step 122 so as to deposit the replacement tie plate from the feed conveyor to the desired railroad tie or offset therefrom or adjacent thereto as previously described.

The foregoing description of structures and methods have been presented for purposes of illustration. It is not intended to be exhaustive or to limit the invention to the precise steps and/or forms disclosed, and obviously many equivalents, modifications and variations are possible in light of the above teaching. It is intended that the scope of the invention be defined by the claims appended hereto.

What is claimed is:

1. A method for positioning a replacement railroad tie plate along a railroad, comprising the steps of:

positioning a carrier vehicle on a railroad track;

positioning a feed conveyor on said railroad track for movement with said carrier vehicle;

moving a sensor assembly a first distance in a longitudinal direction of said feed conveyor and relative to a release point, said first distance dependent upon a second distance between two adjacent railroad ties;

moving said carrier vehicle and said feed conveyor along said railroad track;

detecting an in-service tie plate with said sensor assembly; and, actuating a gate assembly upon said detection of said in-service tie plate.

2. The method of claim 1 wherein said detecting is performed by a laser sensor.

3. The method of claim 1 wherein said detecting is performed by an optical sensor.

4. The method of claim 1 wherein said detecting is performed by a magnetic sensor.

5. The method of claim 1 wherein said detecting is performed mechanically by engaging at least one of said in-service tie plates or said railroad ties.

6. The method of claim 1 further comprising dispensing a replacement tie plate on a railroad tie.

7. The method of claim 1 further comprising dispensing a replacement tie plate adjacent to a railroad tie.

8. The method of positioning a replacement railroad tie plate along a railroad track, comprising the steps of:

positioning a carrier vehicle and a feed conveyor and railroad track;

adjusting a sensor assembly in a longitudinal direction of said feed conveyor either toward or away from an ejection opening, a distance of said adjustment being dependent upon a distance between two adjacent in-service tie plates;

feeding replacement tie plates from said carrier vehicle to said feed conveyor;

urging said feed conveyor along said railroad track with said carrier vehicle;

detecting in-service tie plates with said sensor assembly;

actuating a gate assembly to release a replacement tie plate upon said detecting.

9. The method of claim 8 wherein said actuating is electric.

10. The method of claim 8 wherein said actuating is pneumatic.

11. The method of claim 8 wherein said actuating is hydraulic.

12. The method of claim 8 wherein said actuating is mechanical.

13. A method for positioning a replacement railroad tie plate along a railroad track, comprising the steps of:

positioning a carrier vehicle and feed conveyor on a railroad track;

adjusting a sensor assembly relative to a release point of said feed conveyor depending on a distance between adjacent railroad ties;

urging said carrier vehicle and said feed conveyor along said railroad track;

feeding tie plates from said carrier vehicle to said feed conveyor;

detecting an in-service tie plate along said railroad track;

actuating a gate-assembly when said in-service tie plate is detected;

depositing a replacement tie plate on one of said railroad tie or an adjacent railroad tie.

14. The method of claim 13 further comprising adjusting said sensor assembly in a longitudinal direction.

15. The method of claim 13 further comprising adjusting said sensor assembly in a direction other than longitudinal.

16. The method of claim 13, said depositing being in a longitudinal direction.

17. The method of claim 13, said depositing being in a direction substantially perpendicular to said longitudinal direction.

18. The method of claim 13 further comprising adjusting said feed conveyor based on a size of said replacement tie plate.

19. The method of claim 13 further comprising positioning a sensor assembly on a bracket, said sensor assembly being movable relative to said bracket.

20. The method of claim 13 further comprising a sensor assembly on a bracket, said bracket being movable relative to said feed conveyor.

21. The method of claim 13, said actuating being one of electric, hydraulic, pneumatic and mechanical.

* * * * *